United States Patent [19]

Lee

[11] 4,241,911

[45] Dec. 30, 1980

[54] STRIPPING ROLLER WITH PROTECTIVE SLEEVE

[75] Inventor: Conrad E. Lee, Golden Valley, Minn.

[73] Assignee: Pako Corporation, Minneapolis, Minn.

[21] Appl. No.: 80,688

[22] Filed: Oct. 1, 1979

[51] Int. Cl.[3] ..... B65H 29/20; B65H 27/00

[52] U.S. Cl. ..... 271/314; 271/307; 226/5; 226/186; 226/191

[58] Field of Search ..... 271/314, 272, 273, 274, 271/276, DIG. 2, 307, 174; 226/5, 186, 191

[56] References Cited

U.S. PATENT DOCUMENTS 3,991,996 11/1976 Bass ..... 271/314

*Primary Examiner*—Jeffrey V. Nase
*Assistant Examiner*—Brian Bond
*Attorney, Agent, or Firm*—John W. Adams

[57] ABSTRACT

An improved stripping and transfer roller assembly which is related to the device disclosed and claimed in prior U.S. Pat. No. 3,991,996 assigned the same assignee as the present invention. The present stripping and transfer roller assembly provides a hollow protective reinforcing sleeve element which surrounds and protects the compressible transfer elements and also permits compression and expansion of said elements during the transfer of a film sheet.

4 Claims, 8 Drawing Figures

STRIPPING ROLLER WITH PROTECTIVE SLEEVE

BACKGROUND OF THE INVENTION

While the device disclosed and claimed in said prior patent worked relatively satisfactorily, it was found that the trailing edges of the film sheets being transferred damaged the compressible outer ends of the stripping and transfer elements and the present invention provides a protective outer shell surrounding the outwardly extending transfer elements and is also being retractable with said transfer elements when the same are compressed.

SUMMARY OF THE INVENTION

The present invention is specifically designed to provide an outer protective element surrounding the soft resilient compressible stripping and transfer elements normally extending outwardly beyond the periphery of a hollow transfer roller while being radially retractable into the hollow transfer roller when said compressible transfer elements are compressed during the transfer of the film sheets by said roller and being expandable with said transfer elements when the same expand to engage the trailing edge of the sheet being transferred and deliver the same laterally outwardly from said roller into the upright storage bin.

DETAILED DESCRIPTION OF THE PREFERRED EMBODIMENT

Figure 1:
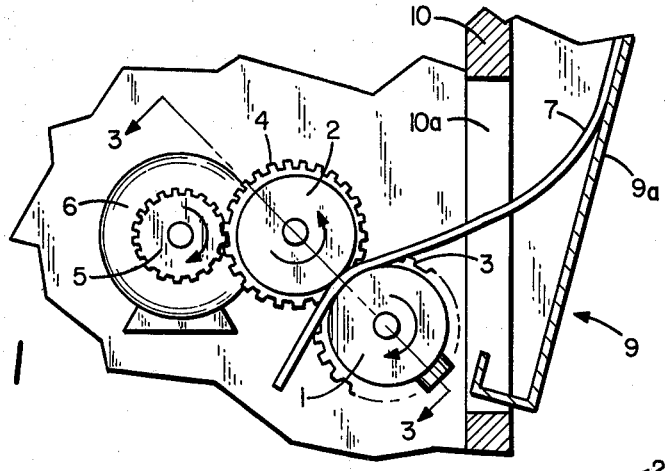
FIG. 1 is a front elevational view of the roller assembly and film sheet-receiving bin.
Figure 8:
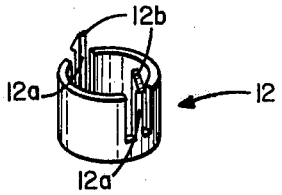
FIG. 8 is a perspective view showing the protective sleeve, per se.
Figure 2:
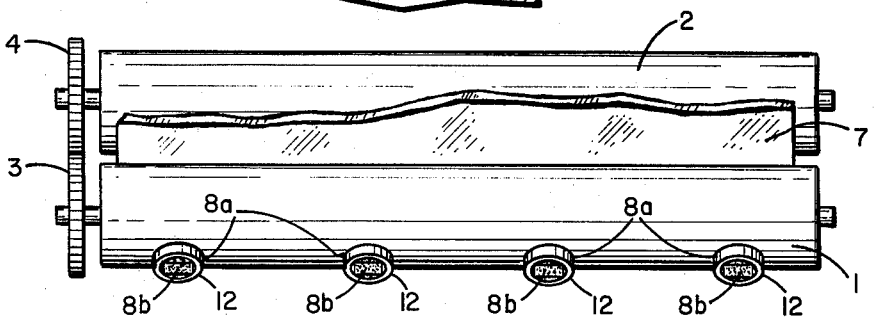
FIG. 2 is a side elevational view of the roller assembly.
Figure 3:
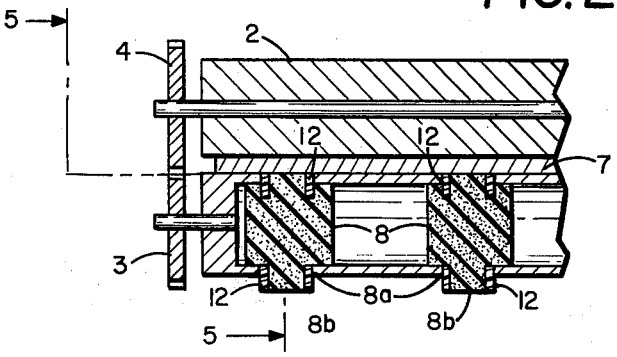
FIG. 3 is a longitudinal sectional view of the roller assembly taken substantially along the line 3—3 of FIG. 1.
Figure 4:
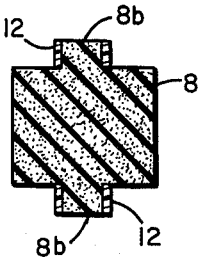
FIG. 4 is a side elevational view of a stripping and transfer element.
Figure 5:
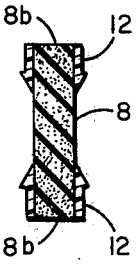
FIG. 5 is a front elevational view of the stripping and transfer element.

Referring to FIG. 1, a pair of rollers 1 and 2 are positioned in closely spaced parallel relation to each other and are interconnected by the pair of meshing gears 3 and 4. Said gear 4 is also meshed with drive gear 5 of motor 6. Said pair of rollers 1 and 2 are closely disposed towards a discharge opening 10*a* of processor wall 10. A plurality of pairs of diametrically opposed openings 8*a* are formed in the hollow roller 1 and, as best shown in FIG. 3, a plurality of soft compressible stripping and transfer elements 8 are inserted into the roller 1 and aligned with the openings 8*a* so that portions 8*b* of either end of the elements 8 extend or protrude through the openings 8*a* and beyond the outer surface of roller 1. Said elements 8 are generally cross-shaped, as shown in FIGS. 4 and 5, the transverse portions thereof being slightly wider than the inside diameter of roller 1 so that the elements 8 must be somewhat compressed when inserted thereinto. FIG. 3 shows how the transverse portions of the elements 8 compress to conform to the inner surface of roller 1 and ensure continued proper alignment of the longitudinal protruding portions 8*b* with the corresponding openings 8*a*. A generally upstanding film sheet receiving bin 9 is positioned in closely spaced relation to roller 1 and extends into opening 10*a* of wall 10 which opening permits the sheets of film 7 to pass into the bin. In FIG. 2, a sheet of film 7 is shown positioned between rollers 1 and 2 and in driving contact therewith.

A protective sleeve 12 surrounds each of the protruding portions 8*b*, as best shown in FIGS. 2 through 7. The sleeves 12 are slightly smaller than the openings 8*a* in the roller 1 to permit the same to slide freely therein. A pair of spring arms 12*a* are formed by slits in the sidewall of each sleeve 12 and bayonet-type retaining elements 12*b* are provided at the inner free ends of the arms and extend a slight distance inwardly beyond the inner end of the sleeve body portion. The bayonet-type retaining elements snap into the hollow roller 1 and engage the inside wall surface to retain the sleeves 12 in operative position around the protruding portions 8*b* of stripping and transfer elements 8.

In typical operation, means (not shown) transport each sheet 7 into contact with rollers 1 and 2. Motor 6 rotates rollers 1 and 2 and thus drives sheet 7 between rollers 1 and 2 and into contact with the closed, remote panel 9*a* of bin 9.

As the protruding portions 8*b* of elements 8, with the sleeves 12 surrounding the same, are rotated into contact with the outer surface of roller 2, they are radially compressed into the openings 8*a* as shown in FIG. 3. The compressed portions 8*a* with the retracted sleeves 12 therearound press outwardly on sheet 7.

As roller 1 is rotated, said portions 8*b* and sleeves 12 are moved out of contact with roller 2 and expand to their normal radially outwardly beyond the outer surface of roller 1. This expansion forces, or strips, sheet 7 from roller 1.

Figure 7:
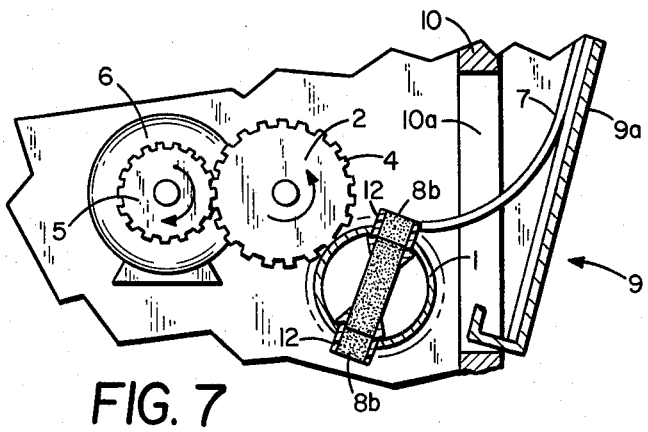
FIG. 7 is a front elevational view of the roller assembly and bin showing the engagement of the trailing edge of a film sheet by the protruding portions of the elements.
Figure 6:
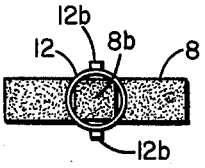
FIG. 6 is a top plan view of the element shown in FIGS. 4 and 5.

Rollers 1 and 2 drive the leading edge of sheet 7 into contact with bin wall 9*a*, which guides the upper end of sheet 7 upwardly, as shown in FIG. 1. When the trailing edge of sheet 7 is driven out of contact with roller 2, it momentarily rides on the outer surface of roller 1 until it engages the sleeves 12 surrounding protruding portions 8*b*. As roller 1 rotates the sleeves 12, in contact with the lower edge of the film, move it laterally towards bin 9, as best shown in FIG. 7. The trailing edge will be dropped from roller 1 and onto the sloping bottom of bin 9. In this manner sheet 7 is deposited in a generally upright position in bin 9, as shown.

The protective sleeves 12 add substantially to the life of the relatively soft protruding portions 8*b*. However, if one of the protruding portions 8*b* of an element 8 should break off, that element is removed from its hole 8*a* in roller 1 along with sleeves 12, and a new element 8 is compressed to insert it into roller 1 and the protruding portions 8 are then aligned with the corresponding openings 8*a* and extend therethrough. Thereafter the protective sleeve 12 is replaced in surrounding position around each protruding portion 8*b* of the element 8.

It will, of course, be understood that various changes may be made in the form, details, arrangement and proportion of the parts without departing from the scope of the invention, which, generally stated, consists in the matter set forth in the accompanying claim.

What is claimed is:

1. A stripping and transfer roller assembly for discharging from a processing machine into a storage bin, individual sheets of film and stacking the same in upstanding position, said assembly comprising, a hollow roller forming a stripping and transfer roller, said roller having a plurality of axially spaced apart openings formed therein, soft resilient compressible stripping and transfer elements respectively inserted into said hollow roller through the openings formed therein, each of said transfer elements having an end portion thereof normally extending through its respective opening beyond the outer periphery of the roller, means for retaining the elements in operative outwardly extending position, a hollow protective sleeve element surrounding each outwardly extending portion of the transfer elements and slidably mounted in its respective opening, means on each of said protective sleeve element for limiting the outward sliding movement to retain said protective elements in said openings in operative position surrounding the respective outwardly extending portions of the resilient stripping and transfer elements but permitting said protective elements to move inwardly with said outwardly extending resilient portions when the transfer elements are compressed, said roller being oriented to drive the upper portion of the sheet upwardly therefrom in substantially upright position, said protective elements engaging the trailing lower edge of said upright sheet to transfer the same laterally outwardly away from said roller, and means for receiving said sheet in upstanding position when discharged from said roller, 2. The structure set forth in claim 1 and means for retaining said stripping and transfer elements in their respective openings comprising intermediate portions larger than the size of the openings for expanding inside of said roller after insertion through the openings and thus retain said end portions of the elements in operative position.

3. Structure set forth in claim 1 and said hollow roller having the axially spaced apart openings also formed in diametrically opposed relation, and each of said stripping and transfer elements having two end portions normally extending through the diametrically opposed openings beyond the outer periphery of the roller.

4. Structure set forth in claim 1 and said means for limiting the outward sliding movement of the sleeve comprising resiliently yieldable bayonet-like elements on the inner ends of each sleeve mounted to resilient yield to inwardly directed force on the sleeve and thereby pass through its opening in the roller and thereafter spring radially outwardly into engagement with the inside surface of the portion of the hollow roller surrounding said opening and thereby limit the outward movement of the sleeve but permit the same to move inwardly into the roller when pressure is extended against the outer end portion thereof and against the outwardly extending resilient portions of the transfer elements.

* * * * *